US010808205B1

(12) United States Patent
Montes

(10) Patent No.: US 10,808,205 B1
(45) Date of Patent: Oct. 20, 2020

(54) SOLID OVEN CLEANING COMPOSITION AND METHODS FOR THE PREPARATION AND USE THEREOF

(71) Applicant: Magnus Procurement and Logistic Solutions, Inc., Irving, TX (US)

(72) Inventor: Eric Matthew Montes, Allen, TX (US)

(73) Assignee: MAGNUS PROCUREMENT AND LOGISTIC SOLUTIONS, INC., Irving, TX (US)

( * ) Notice: Subject to any disclaimer, the term of this patent is extended or adjusted under 35 U.S.C. 154(b) by 0 days.

(21) Appl. No.: 16/803,790

(22) Filed: Feb. 27, 2020

(51) Int. Cl.

| | |
|---|---|
| ***C11D 1/14*** | (2006.01) |
| ***C11D 3/08*** | (2006.01) |
| ***C11D 3/10*** | (2006.01) |
| ***C11D 3/33*** | (2006.01) |
| ***C11D 3/00*** | (2006.01) |
| ***C11D 17/00*** | (2006.01) |
| ***C11D 3/04*** | (2006.01) |
| ***C11D 11/00*** | (2006.01) |
| ***C11D 3/22*** | (2006.01) |
| ***C11D 3/30*** | (2006.01) |
| ***C11D 3/34*** | (2006.01) |
| ***C11D 1/04*** | (2006.01) |

(52) U.S. Cl.
CPC ..... *C11D 3/0057* (2013.01); *C11D 1/04* (2013.01); *C11D 1/14* (2013.01); *C11D 3/044* (2013.01); *C11D 3/08* (2013.01); *C11D 3/10* (2013.01); *C11D 3/221* (2013.01); *C11D 3/30* (2013.01); *C11D 3/3463* (2013.01); *C11D 11/0023* (2013.01); *C11D 17/0056* (2013.01); *C11D 17/0069* (2013.01); *C11D 17/0073* (2013.01)

(58) Field of Classification Search
CPC .. C11D 1/04; C11D 1/14; C11D 1/662; C11D 3/08; C11D 3/10; C11D 3/044; C11D 3/30; C11D 17/056; C11D 17/0069; C11D 17/0073
USPC ..... 510/191, 197, 225, 227, 228, 229, 445, 510/446, 447, 480, 509, 511
See application file for complete search history.

(56) References Cited

U.S. PATENT DOCUMENTS

| | | | | |
|---|---|---|---|---|
| 6,242,403 | B1 * | 6/2001 | Lammers | C11D 3/06 510/294 |
| 6,773,668 | B1 * | 8/2004 | Everson | A47L 15/4436 134/26 |
| 9,920,288 | B2 * | 3/2018 | Pandey | C11D 1/38 |
| 2002/0004472 | A1 * | 1/2002 | Holderbaum | C11D 17/0078 510/290 |
| 2004/0167504 | A1 * | 8/2004 | Thyzel | A61F 9/00736 606/15 |
| 2005/0148488 | A1 * | 7/2005 | Jekel | C11D 17/0073 510/447 |
| 2007/0009561 | A1 * | 1/2007 | Holderbaum | C11D 17/0073 424/401 |
| 2007/0191251 | A1 * | 8/2007 | Geny | C11D 3/046 510/424 |
| 2009/0197787 | A1 * | 8/2009 | Venet | C11D 17/0078 510/224 |
| 2012/0178664 | A1 * | 7/2012 | Wiedemann | C11D 17/0078 510/224 |
| 2013/0005638 | A1 * | 1/2013 | Drost | C11D 17/0052 510/445 |
| 2014/0323385 | A1 * | 10/2014 | Bartelme | C11D 3/2079 510/446 |
| 2015/0084224 | A1 * | 3/2015 | Stolte | C11D 3/378 264/71 |
| 2015/0133357 | A1 * | 5/2015 | Dotzauer | C11D 1/66 510/218 |
| 2015/0251600 | A1 * | 9/2015 | Mochizuki | G06T 11/203 345/7 |
| 2016/0002576 | A1 * | 1/2016 | Jones | C11D 17/0065 510/446 |
| 2016/0010040 | A1 * | 1/2016 | Pandey | C11D 3/044 510/225 |
| 2017/0247642 | A1 * | 8/2017 | Dotzauer | C11D 3/3765 |
| 2017/0260480 | A1 * | 9/2017 | Stolte | C11D 13/16 |
| 2017/0298304 | A1 * | 10/2017 | Vesterager | C11D 3/0094 |
| 2018/0072969 | A1 * | 3/2018 | McCarthy | C11D 3/38609 |
| 2018/0105766 | A1 * | 4/2018 | Caparros Casco | C11D 3/22 |
| 2018/0134998 | A1 * | 5/2018 | Norman | C11D 3/2003 |
| 2018/0312779 | A1 * | 11/2018 | Hodge | C11D 1/662 |
| 2019/0218482 | A1 * | 7/2019 | Norman | C11D 3/2037 |

FOREIGN PATENT DOCUMENTS

| | | | |
|---|---|---|---|
| WO | WO2017/009648 | * | 1/2017 |

* cited by examiner

*Primary Examiner* — Gregory R Delcotto
(74) *Attorney, Agent, or Firm* — William R. Childs; Childs Law

(57) ABSTRACT

A solid oven cleaning composition is disclosed herein, as well as processes for preparation of the composition and methods for use of the same. A benefit to the solid oven cleaning composition can be providing a solid composition that is compact in size yet effective and efficient to use for cleaning the surfaces of an oven. Benefits to the solid oven cleaning composition can be enabling the use of less cleaning product and less time for cleaning an oven. A benefit to the solid oven cleaning composition can be the requirement of less space for shipment and storage.

11 Claims, 1 Drawing Sheet

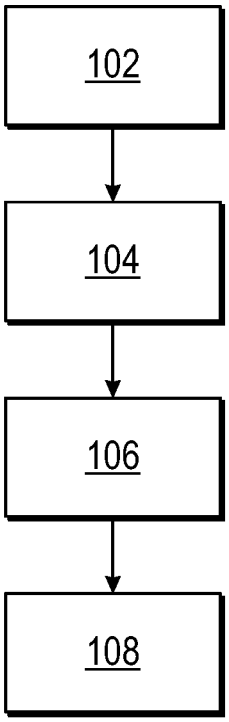
102
104
106
108

SOLID OVEN CLEANING COMPOSITION AND METHODS FOR THE PREPARATION AND USE THEREOF

TECHNICAL FIELD

A solid oven cleaning composition is disclosed herein, as well as processes for preparation of the composition and methods for use of the same. A benefit to the solid oven cleaning composition can be providing a solid composition that is compact in size yet effective and efficient to use for cleaning the surfaces of an oven. Benefits to the solid oven cleaning composition can be enabling the use of less cleaning product and less time for cleaning an oven. A benefit to the solid oven cleaning composition can be the requirement of less space for shipment and storage.

BACKGROUND

Oven cleaning products are widely used to remove grease and other residues from the surfaces of various oven appliances. Chemical oven cleaners typically include a combination of caustic degreasers, detergents, and other additives, and are available as liquid formulations, aerosol sprays, and solid products. For industrial and restaurant ovens, the ideal oven cleaner is one that is safe and easy to use, and can be added to the cleaning port of the oven for a single cleaning operation, without the need for further oven cleaner, repeating the cleaning operation, or manual scrubbing.

SUMMARY

Embodiments herein are directed to solid oven cleaning compositions, processes for preparing a solid oven cleaning composition, kits for cleaning an oven, and methods of cleaning an oven.

In various embodiments of a solid oven cleaning composition herein, the composition includes:

- from about 30% to about 60% by weight of a hydroxide base solid;
- from about 15% to about 35% by weight of a carbonate salt solid;
- from about 10% to about 20% by weight of an alkali silicate solid;
- from about 1% to about 5% by weight of a surfactant; and
- from about 5% to about 15% by weight of a chelator based on a total weight of the solid oven cleaning composition; wherein the composition is formed in a solid tablet.

In certain embodiments, the composition includes:

- from about 40% to about 50% by weight of a hydroxide base solid;
- from about 20% to about 30% by weight of a carbonate salt solid;
- from about 15% to about 18% by weight of an alkali silicate solid;
- from about 2% to about 4% by weight of a surfactant; and
- from about 8% to about 12% by weight of a chelator based on a total weight of the solid oven cleaning composition.

In certain embodiments of the solid oven cleaning composition, the hydroxide base solid includes sodium hydroxide, calcium hydroxide, ammonium hydroxide, or a combination thereof. In certain embodiments, the carbonate salt solid includes sodium carbonate, potassium carbonate, or a combination thereof. In certain embodiments, the alkali silicate solid includes sodium silicate, sodium metasilicate, potassium silicate, or combinations thereof. In certain embodiments, the surfactant includes an alkali surfactant, an anionic surfactant, a cationic surfactant, a non-ionic surfactant, sodium lauryl sulfate, sodium laureth sulfate, or a combination thereof. In certain embodiments, the chelator includes Ethylenediaminetetraacetic acid (EDTA), (ethylene glycol-bis(β-aminoethyl ether)-N,N,N',N'-tetraacetic acid) (EGTA), or a combination thereof.

In certain embodiments, the composition further comprises from about 1% to about 2% by weight of an alkyl glucoside based on a total weight of the solid oven cleaning composition. In certain embodiments, the alkyl glucoside includes D-Glucopyranose, D-glucopyranose oligomers, a decyl octyl glucoside, or a combination thereof.

In some embodiments of the solid oven cleaning composition, the composition includes:

- from about 30% to about 60% by weight of sodium hydroxide;
- from about 15% to about 35% by weight of sodium carbonate;
- from about 10% to about 20% by weight of sodium metasilicate;
- from about 1% to about 5% by weight of sodium lauryl sulfate; and
- from about 5% to about 15% by weight of EDTA based on a total weight of the solid oven cleaning composition.

In various embodiments of the solid oven cleaning composition, the solid tablet has a width of from about 5 cm to about 13 cm, a length of from about 5 cm to about 13 cm, and a thickness of from about 0.6 cm to about 5 cm. In certain embodiments, the solid tablet has a weight of from about 50 g to about 100 g.

Embodiments herein are directed to processes for preparing a solid oven cleaning composition. In some embodiments, the process includes providing a mixture including:

- from about 30% to about 60% by weight of a hydroxide base solid,
- from about 15% to about 35% by weight of a carbonate salt solid,
- from about 10% to about 20% by weight of an alkali silicate solid,
- from about 1% to about 5% by weight of a surfactant, and
- from about 5% to about 15% by weight of a chelator based on a total weight of the solid oven cleaning composition; and forming a solid tablet from the mixture to prepare the solid oven cleaning composition.

In certain embodiments of a process for preparing a solid oven cleaning composition, the mixture includes:

- from about 40% to about 50% by weight of a hydroxide base solid;
- from about 20% to about 30% by weight of a carbonate salt solid;
- from about 15% to about 18% by weight of an alkali silicate solid;
- from about 2% to about 4% by weight of a surfactant; and
- from about 8% to about 12% by weight of a chelator based on a total weight of the solid oven cleaning composition.

In certain embodiments of the process, the hydroxide base solid includes sodium hydroxide, calcium hydroxide, ammonium hydroxide, or a combination thereof. In certain embodiments, the carbonate salt solid includes sodium carbonate, potassium carbonate, or a combination thereof. In certain embodiments, the alkali silicate solid includes sodium silicate, sodium metasilicate, potassium silicate, or combinations thereof. In certain embodiments, the surfactant includes an alkali surfactant, an anionic surfactant, a cationic surfactant, a non-ionic surfactant, sodium lauryl sulfate, sodium laureth sulfate, or a combination thereof. In certain embodiments, the chelator includes EDTA, EGTA, or a combination thereof.

In certain embodiments of a process, the mixture further comprises from about 1% to about 2% by weight of an alkyl glucoside. In certain embodiments, the alkyl glucoside includes D-Glucopyranose, D-glucopyranose oligomers, a decyl octyl glucoside, or a combination thereof.

In certain embodiments of a process herein, the surfactant includes a liquid surfactant, and the process further includes:

- combining the carbonate salt solid, the alkali silicate solid, and the chelator to form a first mixture;
- combining the first mixture with a volume of the liquid surfactant to form a homogeneous second mixture; and
- combining the second mixture with the hydroxide base solid to form a homogeneous third mixture; and
- forming the solid tablet from the third mixture.

In certain embodiments of a process herein, the solid tablet is formed by pressing or molding the mixture into a shape of the solid tablet.

Embodiments herein are directed to kits for cleaning an oven. In certain embodiments, a kit includes:

at least one vessel containing a solid tablet, wherein the solid tablet includes

- from about 30% to about 60% by weight of a hydroxide base solid;
- from about 15% to about 35% by weight of a carbonate salt solid;
- from about 10% to about 20% by weight of an alkali silicate solid;
- from about 1% to about 5% by weight of a surfactant; and
- from about 5% to about 15% by weight of a chelator based on a total weight of the solid tablet.

In certain embodiments of a kit herein, the mixture includes:

- from about 40% to about 50% by weight of a hydroxide base solid;
- from about 20% to about 30% by weight of a carbonate salt solid;
- from about 15% to about 18% by weight of an alkali silicate solid;
- from about 2% to about 4% by weight of a surfactant; and
- from about 8% to about 12% by weight of a chelator based on a total weight of the solid tablet.

In certain embodiments of a kit herein, the hydroxide base solid includes sodium hydroxide, calcium hydroxide, ammonium hydroxide, or a combination thereof. In certain embodiments, the carbonate salt solid includes sodium carbonate, potassium carbonate, or a combination thereof. In certain embodiments, the alkali silicate solid includes sodium silicate, sodium metasilicate, potassium silicate, or combinations thereof. In certain embodiments, the surfactant includes an alkali surfactant, an anionic surfactant, a cationic surfactant, a non-ionic surfactant, sodium lauryl sulfate, sodium laureth sulfate, or a combination thereof. In certain embodiments, the chelator includes EDTA, EGTA, or a combination thereof.

In certain embodiments of a kit herein, the mixture further comprises from about 1% to about 2% by weight of an alkyl glucoside. In certain embodiments, the alkyl glucoside includes D-Glucopyranose, D-glucopyranose oligomers, a decyl octyl glucoside, or a combination thereof.

In certain embodiments of a kit herein, the mixture includes:

- from about 30% to about 60% by weight of sodium hydroxide;
- from about 15% to about 35% by weight of sodium carbonate;
- from about 10% to about 20% by weight of sodium metasilicate;
- from about 1% to about 5% by weight of sodium lauryl sulfate; and
- from about 5% to about 15% by weight of EDTA based on a total weight of the mixture.

In certain embodiments of kits herein, the at least one vessel is formed from a paper material, a plastic material, a plastic lined paper material, a wax paper, or a combination thereof. In certain embodiments, the vessel is sealed. In some embodiments, the vessel material is watertight, water resistant, or humidity resistant.

Embodiments herein are directed to methods for cleaning an oven. In an aspect, such a method includes: removing a solid tablet of claim 1 from a vessel; wherein the vessel is formed from a paper material, a plastic material, a plastic lined paper material, a wax paper, or a combination thereof, and the vessel is watertight, water resistant, or humidity resistant; placing the solid tablet in a cleaning port of the oven; and engaging a cleaning process of the oven for a duration. In certain embodiments, the duration ranges from about 10 minutes to about 4 hours.

BRIEF DESCRIPTION OF THE DRAWINGS

The foregoing summary, as well as the following detailed description of the embodiments, will be better understood when read in conjunction with the attached drawings. For the purpose of illustration, there are shown in the drawings some embodiments, which may be preferable. It should be understood that the embodiments depicted are not limited to the precise details shown. Unless otherwise noted, the drawings are not to scale.

FIG. 1 is a flow chart depicting a process for preparing a solid oven cleaning composition according to some embodiments herein.

DETAILED DESCRIPTION

Unless otherwise noted, all measurements are in standard metric units.

Unless otherwise noted, all instances of the words "a," "an," or "the" can refer to one or more than one of the word that they modify.

Unless otherwise noted, the phrase "at least one of" means one or more than one of an object. For example, "at least one vessel" means one vessel, more than one vessel, or any combination thereof.

Unless otherwise noted, the term "about" refers to ±10% of the non-percentage number that is described, rounded to the nearest whole integer. For example, about 100 g, would include 90 to 110 g. Unless otherwise noted, the term "about" refers to ±5% of a percentage number. For example, about 50% would include 45 to 55%. When the term "about" is discussed in terms of a range, then the term refers to the appropriate amount less than the lower limit and more than the upper limit. For example, from about 5 cm to about 13 cm would include from 4 to 14 cm.

Unless otherwise noted, properties (height, width, length, ratio etc.) as described herein are understood to be averaged measurements.

Unless otherwise noted, the terms "provide", "provided" or "providing" refer to the supply, production, purchase, manufacture, assembly, formation, selection, configuration, conversion, introduction, addition, or incorporation of any element, amount, component, reagent, quantity, measurement, or analysis of any method or system of any embodiment herein.

Oven cleaning products are commonly used to remove grease, fats, proteins, and other substances from the surfaces of oven appliances. Greasy food residues can build up to troublesome levels in ovens that are in regular use. Oven cleaners must therefore be used frequently to keep the ovens in good working order.

Commercial ovens are a requirement in today's restaurants, bars, hotels, and hospitals. Frequent cleaning of these ovens is especially necessary considering these ovens are often in use on a daily basis year-round. A dirty oven not only leads to excessive smoke and foul odors, it poses a risk of fire as food and grease burned onto the oven surface will continue to burn whenever the oven is used. Smoke particles can also be detrimental to health when inhaled. Proper and frequent cleaning of commercial ovens is therefore necessary.

A soiled oven must be cleaned with the use of a product that can effectively remove the residues built up on the oven surface. Several ingredients are commonly used in commercial oven cleaners. In addition to surfactants and chelating agents, alkali agents are often included as degreasers, including hydroxide base solids such as sodium hydroxide, also known as caustic soda or lye. Potassium hydroxide, also known as caustic potash, can also be included as an alkali agent. Oven cleaners containing such caustic cleaning agents are considered to be the most effective for cleaning oven surfaces, particularly if the surfaces are heavily soiled. While they may be effective as oven cleaners, such highly alkaline products can be highly corrosive, and pose significant safety and environmental hazards. Exposure to caustic cleaning agents can cause burns to the skin and eye irritation, as well as damage to many surfaces. Some oven cleaners omit the highly caustic reagents, relying on surfactants to remove the soil. While such products may be safer to use and more environmentally friendly, they are generally more limited in their cleaning effectiveness, and will take longer to work.

Liquid oven cleaning products are widely used. Liquid formulations are typically provided in an aqueous solution, and many are sold as aerosol spray products. A large issue with the aerosol sprays is that the product is dispensed at speed, making accurate spraying onto oven surfaces impossible without first covering and protecting the surfaces that should not contact the cleaner. Liquid sprays also increase the risk that a user will inhale toxic fumes. The use of such cleaners can be difficult and time consuming, increasing the risk of exposure to caustic and corrosive chemicals during cleaning of the equipment. Additionally, liquid oven cleaning products sold in plastic or metal containers are heavy and bulky, so that they take up a large amount of transport space for shipment, as well as adding a considerable amount of weight. Government regulations may also impose certain requirements for the disposal of containers of liquid materials regarded as hazardous. Oven cleaning products sold as solid formulations can have advantages of lower costs for shipping due to less weight and lower space requirements, as well as generally presenting fewer difficulties in complying with safety regulations. Packaging for solid formulations are also generally more convenient and easier to store and dispose of safely than liquid containers.

While solid oven cleaning products offer certain advantages, they generally contain highly caustic ingredients, so that their use poses safety and environmental hazards. Like the liquid formulations, caustic agents are included to maximize the effectiveness of the cleaning products. Solid oven cleaners in a tablet or cake form are often used in commercial ovens with automatic cleaning functions. A desired number of tablets is typically placed in the cavity drain or other dispensing container in the oven, after which the door to the oven is closed, and the cleaning cycle is started by the user. While there may be less exposure to cleaning product required than with manual cleaning, the user must still open the cleaning product packaging and handle the product to place it in the oven. A large amount of product, or a number of solid tablets, may be required to effectively clean the oven. Using more cleaning product each time an oven is cleaned translates to higher costs. The less time a user has to spend handling a caustic cleaning product, and the less product that is required to clean the oven, the better.

Commercial oven cleaning cycles can also be very time consuming. Due to commercial ovens being in frequent use throughout the day, oven cleaning is often performed late at the end of the day, so that operation of the oven is not interrupted during business hours. Oven cleaning cycles can typically take hours to complete, which can result in late working hours for staff.

There remains a need in the art for solid oven cleaning compositions that can provide benefits of a compact product size, and yet be effective and efficient to use for cleaning the surfaces of an oven. There remains a need in the art for solid oven cleaning compositions that can provide benefits of the use of less cleaning product and less time for cleaning an oven, saving time and money. There remains a need in the art for solid oven cleaning compositions requiring less space for shipment and storage.

Embodiments of the present disclosure can provide a solid oven cleaning composition formed in a solid tablet and having a compact size. Embodiments herein can provide benefits of economy in cleaning product usage and time savings for the cleaning of an oven. Embodiments herein can provide a benefit of reduced exposure to hazardous caustic cleaning agents during cleaning of an oven. Embodiments herein can provide a benefit of a solid oven cleaning composition that can be efficiently shipped and stored.

Solid Oven Cleaning Compositions of Various Embodiments

Embodiments herein are directed to solid oven cleaning compositions, processes for preparing a solid oven cleaning composition, kits for cleaning an oven, and methods of cleaning an oven.

In various embodiments of a solid oven cleaning composition herein, the composition includes:

- from about 30% to about 60% by weight of a hydroxide base solid;
- from about 15% to about 35% by weight of a carbonate salt solid;
- from about 10% to about 20% by weight of an alkali silicate solid;
- from about 1% to about 5% by weight of a surfactant; and
- from about 5% to about 15% by weight of a chelator, based on a total weight of the solid oven cleaning composition, wherein the composition is formed in a solid tablet.

In certain embodiments, the composition includes:

- from about 40% to about 50% by weight of a hydroxide base solid;
- from about 20% to about 30% by weight of a carbonate salt solid;

from about 15% to about 18% by weight of an alkali silicate solid;

from about 2% to about 4% by weight of a surfactant; and from about 8% to about 12% by weight of a chelator based on a total weight of the solid oven cleaning composition.

In certain embodiments of the solid oven cleaning composition, the hydroxide base solid includes sodium hydroxide, calcium hydroxide, ammonium hydroxide, potassium hydroxide, or a combination thereof. The hydroxide base solid can provide a benefit of an alkali agent to aid the removal of grease and other residues from the surfaces of an oven. The hydroxide base solid can provide a benefit of acting as a builder to increase the cleaning efficiency of one or more surfactants in the composition. In an embodiment, the solid oven cleaning composition includes from about 30% to about 60% by weight of a hydroxide base solid based on a total weight of the solid oven cleaning composition. If the percentage of hydroxide base solid falls below 30%, then the cleaning power of a strong base is lost. If the percentage of hydroxide base solid goes above 60%, then the solid oven cleaning composition is too caustic, causing safety and corrosion issues.

In certain embodiments, the carbonate salt solid includes sodium carbonate, potassium carbonate, or a combination thereof. The carbonate salt solid can provide a benefit of acting as and alkali agent, and as a builder to increase the cleaning efficiency of one or more surfactants in the composition. In an embodiment, the solid oven cleaning composition includes from about 15% to about 35% by weight of a carbonate salt solid based on a total weight of the solid oven cleaning composition. If the percentage of carbonate salt solid falls below 15%, then too much of the cleaning power of a weak base is lost. If the percentage of carbonate salt solid goes above 35%, then the solid oven cleaning composition is too caustic, causing safety and corrosion issues.

In certain embodiments, the alkali silicate solid includes sodium silicate, sodium metasilicate, potassium silicate, or combinations thereof. The alkali silicate solid can provide benefits of acting as an alkali agent, as a builder to increase the cleaning efficiency of the composition, as a corrosion inhibitor, and as an abrasive. In an embodiment, the solid oven cleaning composition includes from about 10% to about 20% by weight of an alkali silicate solid based on a total weight of the solid oven cleaning composition. If the percentage of alkali silicate solid falls below 10%, then the solid oven cleaning composition becomes too corrosive. If the percentage of alkali silicate solid goes above 20%, then too much cleaning power is lost.

In certain embodiments, the solid oven cleaning composition can include one or more additional builders, which can include one or more inorganic phosphates, one or more zeolites, one or more organic citrates, or combinations thereof. In certain embodiments, the solid oven cleaning composition can include one or more preservatives.

In certain embodiments, the solid oven cleaning composition includes a percentage by weight ratio of hydroxide base solid to alkali silicate solid of from about 60%:10% to about 30%:20% based on a total weight of the composition. If the percentage by weight ratio of hydroxide base solid to alkali silicate solid falls below 30%:20%, then the cleaning power of a strong base is lost. If the weight ratio of hydroxide base solid to alkali silicate solid goes above 60%:10%, then the solid oven cleaning composition is too caustic, causing safety and corrosion issues.

In certain embodiments, the solid oven cleaning composition includes a percentage weight ratio of carbonate salt solid to alkali silicate solid of from about 35%:10% to about 15%:20% based on a total weight of the composition. If the percentage by weight ratio of carbonate salt solid to alkali silicate solid falls below 15%:20%, then the cleaning power of a strong base is lost. If the percentage by weight ratio of carbonate salt solid to alkali silicate solid goes above 35%:10%, then the solid oven cleaning composition is too caustic, causing safety and corrosion issues.

In certain embodiments, the solid oven cleaning composition includes a percentage weight ratio of hydroxide base solid and carbonate salt solid combined to alkali silicate solid of from about 95%:10% to about 45%:20% based on a total weight of the composition. If the percentage by weight ratio of hydroxide base solid and carbonate salt solid combined to alkali silicate solid falls below 45%:20%, then the cleaning power of a strong base is lost. If the percentage by weight ratio of hydroxide base solid and carbonate salt solid combined to alkali silicate solid goes above 95%:10%, then the solid oven cleaning composition is too caustic, causing safety and corrosion issues.

In certain embodiments, the surfactant includes an alkali surfactant, an anionic surfactant, a cationic surfactant, a non-ionic surfactant, sodium lauryl sulfate, sodium laureth sulfate, or a combination thereof. In certain embodiments, the surfactant includes a fatty alcohol sulfate, sodium cocoyl sulfate, a fatty alcohol polyglycol ether, or a combination thereof. The surfactant can provide a benefit of increasing the cleaning ability of the composition, by aiding the removal of grease and other residues from the surfaces of an oven. In an embodiment, the solid oven cleaning composition includes from about 1% to about 5% by weight of a surfactant based on a total weight of the solid oven cleaning composition. If the percentage of surfactant falls below 1%, then the solid oven cleaning composition loses the ability to effectively remove particles into water. If the percentage of surfactant goes above 5%, then the solid oven cleaning composition produces too much foam, which leads to difficulty in pumping liquids throughout the oven, and too much residue from bubbles.

In certain embodiments, the chelator includes Ethylenediaminetetraacetic acid (EDTA), (ethylene glycol-bis(β-aminoethyl ether)-N,N,N',N'-tetraacetic acid) (EGTA), or a combination thereof. The chelator can provide a benefit of chelating and sequestering metal ions that may interfere with the cleaning ability of the composition.

In certain embodiments, the composition further comprises from about 1% to about 2% by weight of an alkyl glucoside. In certain embodiments, the alkyl glucoside includes D-Glucopyranose, D-glucopyranose oligomers, a decyl octyl glucoside, or a combination thereof. In certain embodiments, the alkyl glucoside includes an alkyl polyglucoside, a decyl glucoside, a caprylyl oligolucoside, an alkyl ether, or a combination thereof. In certain embodiments, the alkyl glucoside is derived from a biological source. In various embodiments, the alkyl glucoside can provide a benefit of a surfactant activity to the solid oven cleaning composition.

In some embodiments of the solid oven cleaning composition, the composition includes:

from about 30% to about 60% by weight of sodium hydroxide;

from about 15% to about 35% by weight of sodium carbonate;

from about 10% to about 20% by weight of sodium metasilicate;

from about 1% to about 5% by weight of sodium lauryl sulfate; and from about 5% to about 15% by weight of EDTA based on a total weight of the solid oven cleaning composition.

In various embodiments of the solid oven cleaning composition, the solid tablet has a width of from about 5 cm to about 13 cm, a length of from about 5 cm to about 13 cm, and a thickness of from about 0.6 cm to about 5 cm. In certain embodiments, the solid tablet has a width of from about 6 cm to about 12 cm, a length of from about 6 cm to about 12 cm, and a thickness of from about 1 cm to about 4 cm. In certain embodiments, the solid tablet has a width of from about 7 cm to about 11 cm, a length of from about 7 cm to about 11 cm, and a thickness of from about 1.5 cm to about 3.5 cm. In certain embodiments, the solid tablet has a width of from about 8 cm to about 10 cm, a length of from about 8 cm to about 10 cm, and a thickness of from about 2 cm to about 3 cm. Such embodiments can provide a benefit of a solid oven cleaning composition formed in a solid tablet having a compact size. If the measurement of the tablet falls below a width of 5 cm, a length of 5 cm, and/or a thickness of 0.6 cm, then the dose contained is insufficient to clean most industrial size ovens. If the measurement of the tablet goes above 13 cm in width, 13 cm in length, or 5 cm thickness, especially thickness, then the proportions of the tablet will not fit inside the cleaning port of most industrial ovens.

Such embodiments can provide a benefit of enabling the use of less cleaning product for an effective cleaning cycle of an oven. Such embodiments can provide benefits of economy in cleaning product usage and associated costs. Such embodiments can provide benefits of reduced exposure to hazardous caustic cleaning agents during cleaning of an oven, and a solid oven cleaning composition that can be efficiently shipped and stored.

In certain embodiments, the solid tablet has a weight of from about 50 g to about 100 g. In certain embodiments, the solid tablet has a weight of from about 60 g to about 90 g. In certain embodiments, the solid tablet has a weight of from about 70 g to about 80 g. Such embodiments can provide a benefit of enabling the use of less cleaning product for an effective cleaning cycle of an oven. Such embodiments can provide benefits of reduced exposure to hazardous caustic cleaning agents during cleaning of an oven, and a solid oven cleaning composition that can be efficiently shipped and stored.

Processes for Preparing a Solid Oven Cleaning Composition of Various Embodiments Embodiments herein are directed to processes for preparing a solid oven cleaning composition. As a general overview of a process disclosed herein, referring to FIG. 1, embodiments of a process include combining a carbonate salt solid, an alkali silicate solid, and a chelator to form a first mixture 102; combining first mixture 102 with a volume of a liquid surfactant to form homogeneous second mixture 104; combining homogeneous mixture 104 with a hydroxide base solid to form homogeneous third mixture 106, wherein homogeneous third mixture 106 includes from about 30% to about 60% by weight of the hydroxide base solid, from about 15% to about 35% by weight of the carbonate salt solid, from about 10% to about 20% by weight of the alkali silicate solid, from about 1% to about 5% by weight of the liquid surfactant, and from about 5% to about 15% by weight of the chelator; and forming a solid tablet 108 from homogeneous third mixture 106.

In some embodiments, the process includes providing a mixture including:

from about 30% to about 60% by weight of a hydroxide base solid, from about 15% to about 35% by weight of a carbonate salt solid, from about 10% to about 20% by weight of an alkali silicate solid, from about 1% to about 5% by weight of a surfactant, and from about 5% to about 15% by weight of a chelator based on a total weight of the mixture; and forming a solid tablet from the mixture to prepare the solid oven cleaning composition.

In certain embodiments of a process for preparing a solid oven cleaning composition, the mixture includes:

from about 40% to about 50% by weight of a hydroxide base solid;

from about 20% to about 30% by weight of a carbonate salt solid;

from about 15% to about 18% by weight of an alkali silicate solid;

from about 2% to about 4% by weight of a surfactant; and from about 8% to about 12% by weight of a chelator based on a total weight of the mixture.

In certain embodiments of the process, the hydroxide base solid includes sodium hydroxide, calcium hydroxide, ammonium hydroxide, potassium hydroxide, or a combination thereof. In certain embodiments, the carbonate salt solid includes sodium carbonate, potassium carbonate, or a combination thereof. In certain embodiments, the alkali silicate solid includes sodium silicate, sodium metasilicate, potassium silicate, or combinations thereof. In certain embodiments, the surfactant includes an alkali surfactant, an anionic surfactant, a cationic surfactant, a non-ionic surfactant, sodium lauryl sulfate, sodium laureth sulfate, or a combination thereof. In certain embodiments, the surfactant includes a fatty alcohol sulfate, sodium cocoyl sulfate, a fatty alcohol polyglycol ether, or a combination thereof. In certain embodiments, the chelator includes EDTA, EGTA, or a combination thereof.

In certain embodiments of a process, the mixture further comprises from about 1% to about 2% by weight of an alkyl glucoside. In certain embodiments, the alkyl glucoside includes D-Glucopyranose, D-glucopyranose oligomers, a decyl octyl glucoside, or a combination thereof. In certain embodiments, the alkyl glucoside includes an alkyl polyglucoside, a decyl glucoside, a caprylyl oligolucoside, an alkyl ether, or a combination thereof. In certain embodiments, the alkyl glucoside is derived from a biological source. In various embodiments, the alkyl glucoside can provide a benefit of a surfactant activity to the solid oven cleaning composition.

In certain embodiments of a process herein, the surfactant includes a liquid surfactant, and the process further includes: combining the carbonate salt solid, the alkali silicate solid, and the chelator to form a first mixture; combining the first mixture with a volume of the liquid surfactant to form a homogeneous second mixture; combining the second mixture with the hydroxide base solid to form a homogeneous third mixture; and forming the solid tablet from the third mixture.

In certain embodiments of a process herein, the solid tablet is formed by pressing or molding the mixture into a shape of the solid tablet. In certain embodiments, the solid tablet has a substantially circular shape. In certain embodiments, the solid tablet has a substantially square shape, a substantially rectangular shape, or a substantially oval shape.

Kits of Various Embodiments

It has been discovered that certain solid oven cleaning composition embodiments are hydroscopic, meaning they tend to bind and hold water from the air. If these solid oven cleaning compositions are allowed to sit in humid air for a length of time, then the solid tablet or puck shape will tend to crumble or become brittle. This crumbling or embrittlement makes them difficult to manipulate safely and to measure easily as a single dose for cleaning. An embodiment of sealing the solid oven cleaning composition into at least one vessel can be that little or no moisture is allowed to react with the solid oven cleaning composition, and the shape and dose of the solid oven cleaning composition as an easily handled and measured tablet is preserved.

Embodiments herein are directed to kits for cleaning an oven. In certain embodiments, a kit includes at least one vessel containing a solid tablet, wherein the solid tablet includes:

- from about 30% to about 60% by weight of a hydroxide base solid;
- from about 15% to about 35% by weight of a carbonate salt solid;
- from about 10% to about 20% by weight of an alkali silicate solid;
- from about 1% to about 5% by weight of a surfactant; and
- from about 5% to about 15% by weight of a chelator based on a total weight of the solid tablet.

In certain embodiments of a kit herein, the mixture includes:

- from about 40% to about 50% by weight of a hydroxide base solid;
- from about 20% to about 30% by weight of a carbonate salt solid;
- from about 15% to about 18% by weight of an alkali silicate solid;
- from about 2% to about 4% by weight of a surfactant; and
- from about 8% to about 12% by weight of a chelator based on a total weight of the mixture.

In certain embodiments of a kit herein, the hydroxide base solid includes sodium hydroxide, calcium hydroxide, ammonium hydroxide, potassium hydroxide, or a combination thereof. In certain embodiments, the carbonate salt solid includes sodium carbonate, potassium carbonate, or a combination thereof. In certain embodiments, the alkali silicate solid includes sodium silicate, sodium metasilicate, potassium silicate, or combinations thereof. In certain embodiments, the surfactant includes an alkali surfactant, an anionic surfactant, a cationic surfactant, a non-ionic surfactant, sodium lauryl sulfate, sodium laureth sulfate, or a combination thereof. In certain embodiments, the surfactant includes a fatty alcohol sulfate, sodium cocoyl sulfate, a fatty alcohol polyglycol ether, or a combination thereof. In certain embodiments, the chelator includes EDTA, EGTA, or a combination thereof.

In certain embodiments of a kit herein, the mixture further comprises from about 1% to about 2% by weight of an alkyl glucoside. In certain embodiments, the alkyl glucoside includes D-Glucopyranose, D-glucopyranose oligomers, a decyl octyl glucoside, or a combination thereof. In certain embodiments, the alkyl glucoside includes an alkyl polyglucoside, a decyl glucoside, a caprylyl oligolucoside, an alkyl ether, or a combination thereof. In certain embodiments, the alkyl glucoside is derived from a biological source. In various embodiments, the alkyl glucoside can provide a benefit of a surfactant activity to the solid oven cleaning composition.

In certain embodiments of a kit herein, the mixture includes:

- from about 30% to about 60% by weight of sodium hydroxide;
- from about 15% to about 35% by weight of sodium carbonate;
- from about 10% to about 20% by weight of sodium metasilicate;
- from about 1% to about 5% by weight of sodium lauryl sulfate; and
- from about 5% to about 15% by weight of EDTA based on a total weight of the mixture.

In certain embodiments of kits herein, the at least one vessel is formed from a paper material, a plastic material, a plastic lined paper material, a wax paper, or a combination thereof. In certain embodiments, the vessel is sealed. In some embodiments, the vessel material is watertight, water resistant, or humidity resistant. Such embodiments can provide benefits of reduced exposure to hazardous caustic cleaning agents during cleaning of an oven, and a solid oven cleaning composition that can be efficiently shipped and stored. Embodiments of kits herein can also provide benefits of economy in cleaning product usage and associated costs.

Methods of Cleaning an Oven of Various Embodiments

Embodiments herein are directed to methods for cleaning an oven. In an aspect, such a method includes: removing a solid tablet of claim 1 from a vessel; wherein the vessel is formed from a paper material, a plastic material, a plastic lined paper material, a wax paper, or a combination thereof, and the vessel is watertight, water resistant, or humidity resistant; placing the solid tablet in a cleaning port of the oven; and engaging a cleaning process of the oven for a duration. In certain embodiments, the duration ranges from about 10 minutes to about 4 hours. In an embodiment, the duration ranges from about 9 to about 5 hours. In an embodiment, the duration ranges from about 8 to about 6 hours. Such embodiments can provide a benefit of reducing the duration of time that is typically required for the cleaning process of an oven.

Examples

This example illustrates the preparation of a solid oven cleaning composition according to the embodiments described herein. A solid oven cleaning composition can be prepared according to the following:

I. INGREDIENTS

| INGREDIENTS | CAS NUMBER | Composition, % w/w |
|---|---|---|
| EDTA | 60-00-4 | 10 |
| Sodium Carbonate | 497-19-8 | 25 |
| Sodium Metasilicate | 6834-92-0 | 16 |
| Sodium Lauryl Sulfate | 151-21-3 | 3 |
| Sodium Hydroxide | 1310-73-2 | 45 |
| D-Gluicopyranose, oligomers, decyl octyl glucosides | 68515-73-1 | 1 |

II. Formulation Recipe

1. Mix the carbonate, silicate, EDTA and the surfactant TEXAPON Z.

2. Next, spray the liquid surfactant onto the mixture. Mix continuously while spraying, and continue mixing until the liquid is completely adsorbed and the mixture is homogeneous.

3. Finally, add NaOH and mix thoroughly. Note: NaOH is a hydroscopic ingredient; it should be mixed in a non-humid ambient.

4. Check the homogeneity of the mixture.

What is claimed is:

1. A solid oven cleaning composition consisting of:

from about 30% to about 60% by weight of sodium hydroxide;

from about 15% to about 35% by weight of sodium carbonate;

from about 10% to about 20% by weight of sodium metasilicate;

from about 1% to about 5% by weight of sodium lauryl sulfate;

from about 5% to about 15% by weight of EDTA, and from about 1% to about 2% by weight of an alkyl glucoside based on a total weight of the solid oven cleaning composition; wherein the composition is a solid tablet, and wherein the solid tablet has a width of from about 5 cm to about 13 cm, a length of from about 5 cm to about 13 cm, and a thickness of from about 0.6 cm to about 5 cm, the solid oven cleaning composition comprises a percentage by weight ratio of sodium hydroxide to sodium metasilicate of from about 60%:10% to about 30%:20% based on a total weight of the composition, the solid oven cleaning composition comprises a percentage weight ratio of sodium carbonate to sodium metasilicate of from about 35%:10% to about 15%:20% based on a total weight of the composition, and the solid oven cleaning composition comprises a percentage weight ratio of sodium hydroxide and sodium carbonate combined to sodium metasilicate of from about 95%:10% to about 45%:20% based on a total weight of the composition.

2. The composition of claim 1, wherein the composition consists of from about 40% to about 50% by weight of sodium hydroxide;

from about 20% to about 30% by weight of sodium carbonate;

from about 15% to about 18% by weight of sodium metasilicate;

from about 2% to about 4% by weight of sodium lauryl sulfate; and from about 8% to about 12% by weight of EDTA based on a total weight of the composition.

3. The composition of claim 1, wherein the alkyl glucoside is D-Glucopyranose, D-glucopyranose oligomers, a decyl octyl glucoside, or a combination thereof.

4. A solid oven cleaning composition consisting of:

from about 30% to about 60% by weight of sodium hydroxide;

from about 15% to about 35% by weight of sodium carbonate;

from about 10% to about 20% by weight of sodium metasilicate;

from about 1% to about 5% by weight of sodium lauryl sulfate;

from about 5% to about 15% by weight of EDTA based on a total weight of the composition, and from about 1% to about 2% by weight of an alkyl glucoside based on a total weight of the composition, wherein the alkyl glucoside is D-Glucopyranose, D-glucopyranose oligomers, a decyl octyl glucoside, or a combination thereof, wherein the composition is a solid tablet having a width of from about 5 cm to about 13 cm, a length of from about 5 cm to about 13 cm, and a thickness of from about 0.6 cm to about 5 cm.

5. The composition of claim 1, wherein the solid tablet has a weight of from about 50 g to about 100 g.

6. A process for preparing a solid oven cleaning composition comprising:

providing a mixture, the mixture consisting of from about 30% to about 60% by weight of sodium hydroxide;

from about 15% to about 35% by weight of sodium carbonate;

from about 10% to about 20% by weight of sodium metasilicate;

from about 1% to about 5% by weight of sodium lauryl sulfate;

from about 5% to about 15% by weight of EDTA, and from about 1% to about 2% by weight of an alkyl glucoside based on a total weight of the solid oven cleaning composition; and wherein the solid oven cleaning composition comprises a percentage by weight ratio of sodium hydroxide to sodium metasilicate of from about 60%:10% to about 30%:20% based on a total weight of the composition, the solid oven cleaning composition comprises a percentage weight ratio of sodium carbonate to sodium metasilicate of from about 35%:10% to about 15%:20% based on a total weight of the composition, and the solid oven cleaning composition comprises a percentage weight ratio of sodium hydroxide and sodium carbonate combined to sodium metasilicate of from about 95%:10% to about 45%:20% based on a total weight of the composition; and forming a solid tablet from the mixture to prepare the solid oven cleaning composition, wherein the solid tablet has a width of from about 5 cm to about 13 cm, a length of from about 5 cm to about 13 cm, and a thickness of from about 0.6 cm to about 5 cm.

7. The process of claim 6, wherein the mixture consists of from about 40% to about 50% by weight of sodium hydroxide;

from about 20% to about 30% by weight of sodium carbonate;

from about 15% to about 18% by weight of sodium metasilicate;

from about 2% to about 4% by weight of sodium lauryl sulfate; and from about 8% to about 12% by weight of EDTA based on a total weight of the mixture.

8. The process of claim 6, wherein the alkyl glucoside is D-Glucopyranose, D-glucopyranose oligomers, a decyl octyl glucoside, or a combination thereof.

9. The process of claim 6, comprising forming the tablet by pressing or molding the mixture.

10. A method of cleaning an oven comprising:

removing a solid tablet of claim 1 from a vessel;

wherein the vessel is formed from a paper material, a plastic material, a plastic lined paper material, a wax paper, or a combination thereof, and the vessel is watertight, water resistant, or humidity resistant;

placing the solid tablet in a cleaning port of the oven; and engaging a cleaning process of the oven for a duration.

11. The method of claim 10, wherein the duration ranges from about 10 minutes to about 4 hours.

* * * * *